US006056573A

United States Patent [19]

Nishioka

[11] Patent Number: 6,056,573

[45] Date of Patent: May 2, 2000

[54] IC CARD CONNECTOR

[75] Inventor: Toru Nishioka, Miyagi-ken, Japan

[73] Assignee: Alps Electric Co., Ltd., Tokyo, Japan

[21] Appl. No.: 08/892,963

[22] Filed: Jul. 16, 1997

[30] Foreign Application Priority Data

Jul. 30, 1996 [JP] Japan ..... 8-200388

[51] Int. Cl.[7] ..... H01R 13/62

[52] U.S. Cl. ..... 439/326; 439/630; 439/924.1; 235/441

[58] Field of Search ..... 439/326, 630, 439/188, 924.1; 235/441, 475, 476, 479

[56] References Cited

U.S. PATENT DOCUMENTS 5,302,136 4/1994 St. Germain et al. ..... 439/924.1

FOREIGN PATENT DOCUMENTS 7-8968 2/1995 Japan .
7-8969 2/1995 Japan .

*Primary Examiner*—Gary F. Paumen
*Assistant Examiner*—Katrina Davis
*Attorney, Agent, or Firm*—Brinks Hofer Gilson & Lione

[57] ABSTRACT

A thin design IC card connector which is provided with a sequence mechanism for defining the connection sequence of terminals of an IC card (for example, for ground lines, power supply lines, and signal lines in that order) performs a safe and reliable sequence operation. The IC card connector comprises first brushes that are connected to power supply lines, ground lines and signal lines of an IC card when the IC card is mounted, second brushes that are not directly connected to the first brushes but connected to a circuit board of a host apparatus, and a sequence mechanism which is arranged between the first brushes and the second brushes and which defines the connection sequence of the contact points of the IC card for making or breaking the connections between the first brushes and the second brushes according to the defined connection sequence. By operating the sequence mechanism, a sequence operation is performed with the contact points of the IC card remaining connected to the first brushes.

7 Claims, 9 Drawing Sheets

IC CARD CONNECTOR

BACKGROUND OF THE INVENTION

1. Field of the Invention

The present invention relates to an IC card connector for use in an IC card and a memory card.

2. Description of the Related Art

Some of portable computers, digital cameras and the like recently developed work with an IC card or memory card.

During use, such an IC card is inserted into a socket of a host machine such as a personal computer. The contact points of the IC card are electrically connected via a connector to a circuit board of the personal computer.

Typical connectors that establish the connection of the contact points are disclosed, for example, in Japanese Unexamined Utility Model Publication No. 7-8968 and Japanese Unexamined Utility Model Publication No. 7-8969, and are shown in FIG. 11.

FIG. 11 shows a connector 81 having a plurality of cantilever contacts 80. The housing 82 of the connector 81 includes a slider 83 that moves along with the sliding motion of the connector relative to a host apparatus, for engagement or disengagement motion, a coil spring 84 for returning the slider 83 to its current position, and a curved lever (not shown) for transmitting to the slider 83 the engagement and disengagement of the connector with the host apparatus.

The pressure portion (not shown) of the lever at its one end is projected outside and the other end of the lever is engaged with a curved lever guide (not shown) of the slider 83 so that the lever, inclined with respect to the direction of movement of the slider 83, advances and recedes in its curved configuration kept.

When the connector is engaged with the host apparatus, the slider 83 is moved by the lever, releasing the cantilever contact 80 to let the contact 80 itself project on its own elasticity out of the housing 82. When the connector is disengaged from the host apparatus, the coil spring 84 returns the slider 83 to its original position, permitting the one end of the lever to be projected outside, and forcing the cantilever contact 80 to be receded into the housing 82 against its own elasticity.

FIG. 11 also shows a first connector 85, a connector terminal 86, a contact retraction hole 87, a contact 88, a lead portion 89, a horizontal portion 90, a cover 91, an insulating block 92, a groove 93, a second pressure groove 94, a spring socket 95, and a flange portion 96.

IC card connectors such as memory card connectors are divided into two types: one is built into the IC card and the other is mounted on a portable computer, a digital camera or the like. The market demands the thinnest possible IC card connector.

It is more and more common practice to connect and disconnect the IC card, to and from its host apparatus without bothering switching off power to it before and after the use of the IC card, respectively. In such a case, to protect the IC card, the connection sequence for the contact points on the IC card needs to be defined for connection and disconnection (in sequence operation).

In the above prior art, however, the cantilever contact (brush) 80 moves in a (z) direction perpendicular to the direction (x-y direction) of insertion of the IC card to put itself in contact with a contact of the IC card. A mechanism for moving the cantilever contact (brush) 80 in the z direction is thus required, and furthermore, since the cantilever contact (brush) 80 moves in the z direction, a space for accommodating such a movement is required. This presents a difficulty making the design of the connector compact.

Since a number of cantilever contacts (brushes) 80 are moved in the z direction, a stronger force is required to move then and thus connecting or disconnecting the connector requires a relatively heavy push or pull.

SUMMARY OF THE INVENTION

Accordingly, it is an object of the present invention to provide an IC card connector which is of thin design with a sequence mechanism for defining the connection sequence of terminals of the IC card (for example, ground lines, power supply lines, and signal lines in that order) while still performing a safe and reliable sequence operation.

To achieve the above object, the IC card connector of the present invention in its first aspect comprises brushlike first terminal members that are respectively connected to a plurality of contact points for power supply lines, ground lines and signal lines of an IC card when the IC card is loaded, brushlike second terminal members that are not directly connected to the first terminal members but connected to a circuit board of a host apparatus, and a sequence mechanism which is arranged between the first terminal members and the second terminal members and which defines the connection sequence of the contact points of the IC card to perform a sequence operation by making or breaking the connections between the first terminal members and the second terminal members according to the defined connection sequence, wherein by operating the sequence mechanism, the sequence operation is performed with the contact points of the IC card remaining connected to the first terminal members.

In a second aspect of the present invention, the sequence mechanism according to the first aspect of the present invention comprises a mode circuit board having a plurality of juxtaposed conductor traces that are of different length depending on the connection sequence, wherein the mode circuit board is slidably moved relative to at least either the first terminal members or the second terminal members so that the conductor traces are put into contact therewith.

In a third aspect of the present invention, the mode circuit board of the sequence mechanism according to the second aspect of the present invention is slidably movable in a manner such that the mode circuit board slides along with the opening and the closing operations of the cover of a fixed tray on which the IC card is mounted.

In a fourth aspect of the present invention, the mode circuit board of the sequence mechanism according to the third aspect of the present invention is fixed to a tray or the second terminal members, the tray is supported slidably in the direction of insertion and detraction of the IC card, and the mode circuit board is slid, along with the sliding motion of the tray, relative to the second terminal members, or the first terminal members is slid, along with the sliding motion of the tray, relative to the mode circuit board that is fixed to the second terminal members.

DESCRIPTION OF THE PREFERRED EMBODIMENTS

Figure 1A:
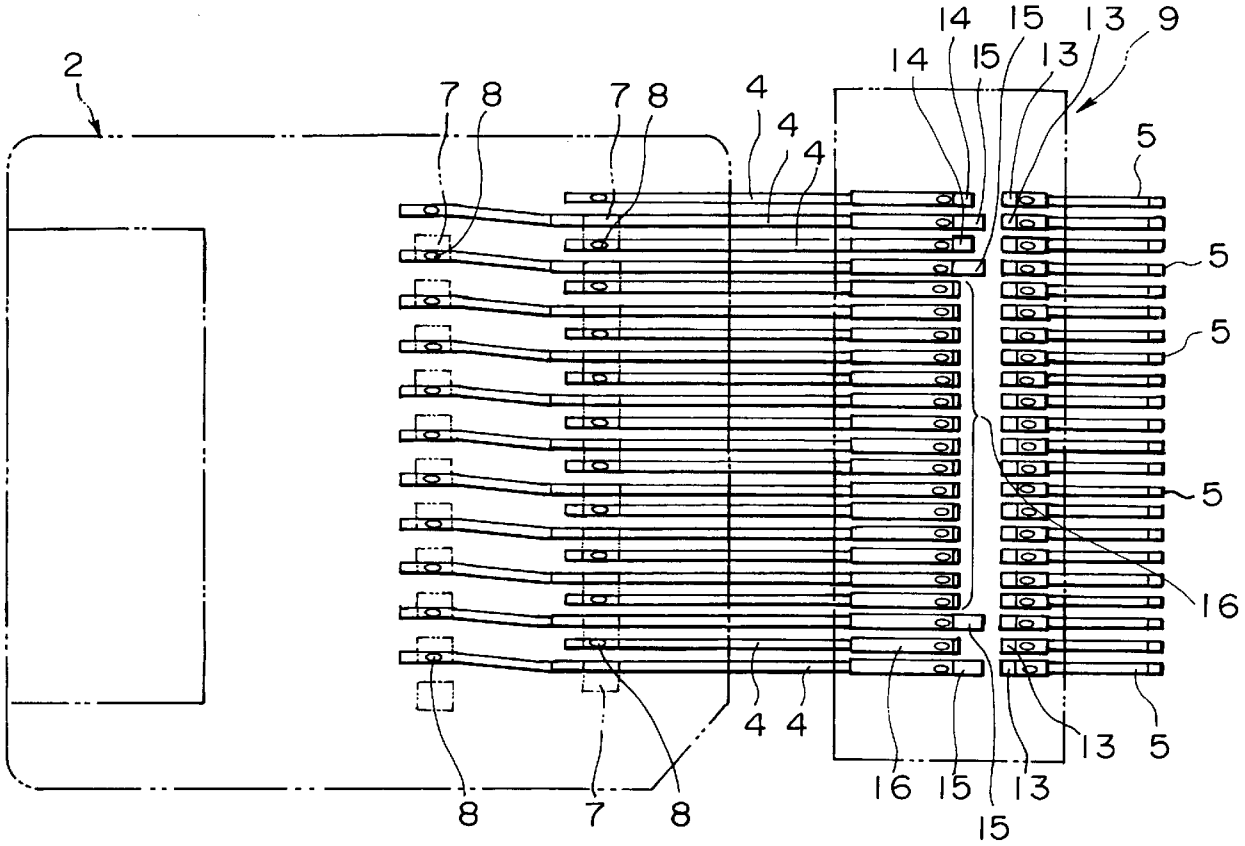
FIGS. 1A and 1B are, respectively, a plan view and a side view showing generally the IC card connector of a first embodiment of the present invention.

Referring to the drawings, the embodiments of the present invention are now discussed.

Figure 1B:
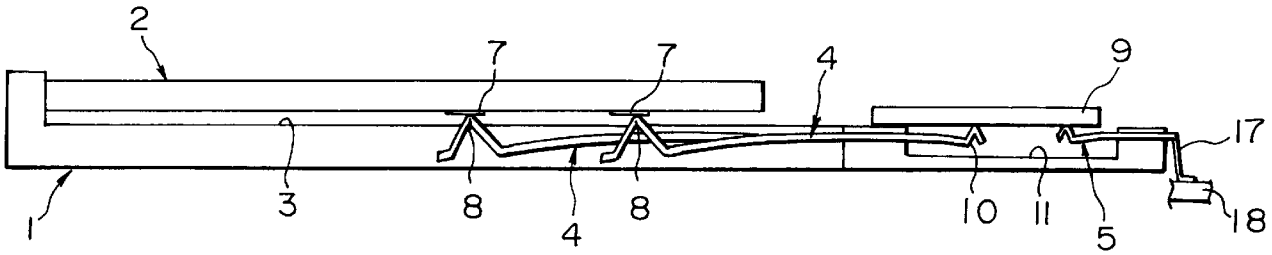
Figure 2A:
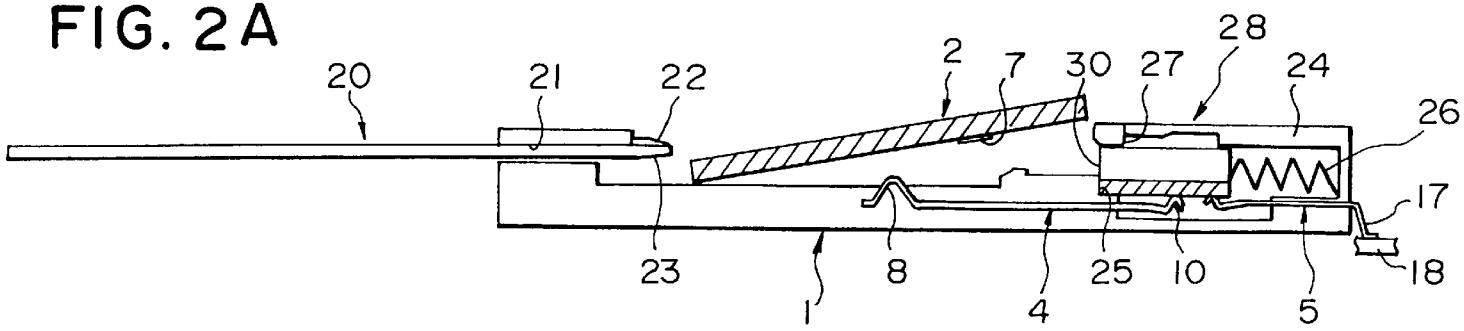
FIGS. 2A–2C show the operation of the IC card connector of the first embodiment of the present invention.
Figure 2B:
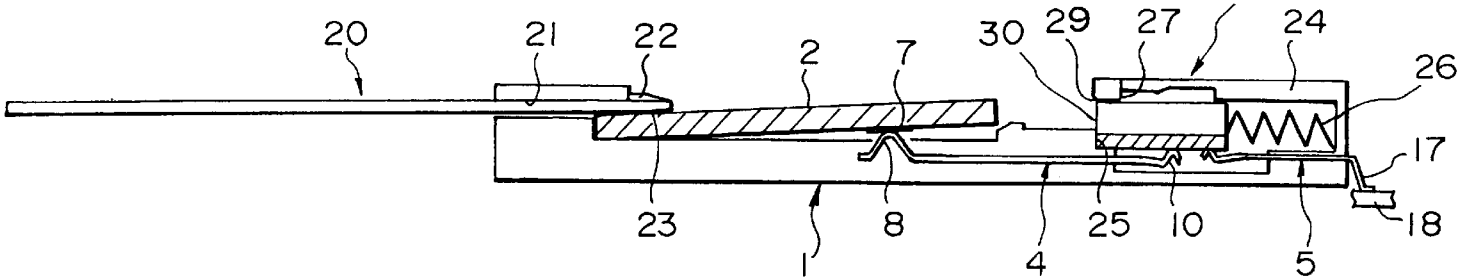
Figure 2C:
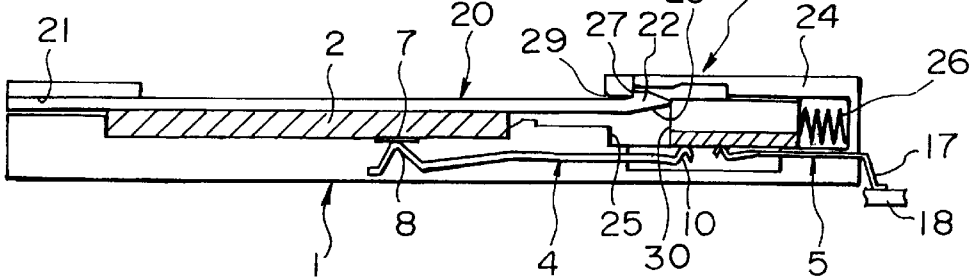
Figure 3A:
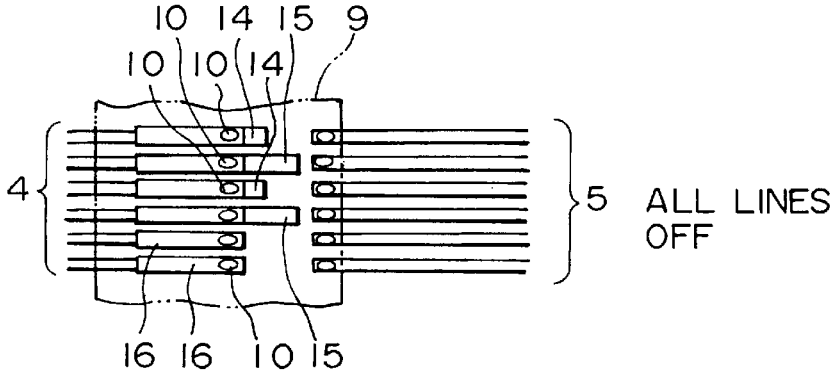
FIGS. 3A–3D show the relationship of first brushes, a mode circuit board and second brushes in the operation of the IC card connector of the first embodiment of the present invention.
Figure 3B:
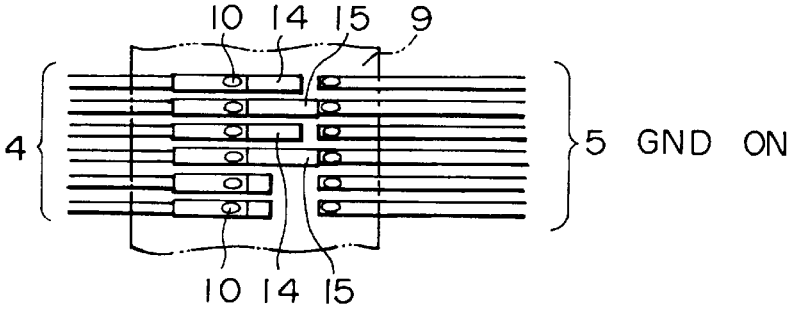
Figure 3C:
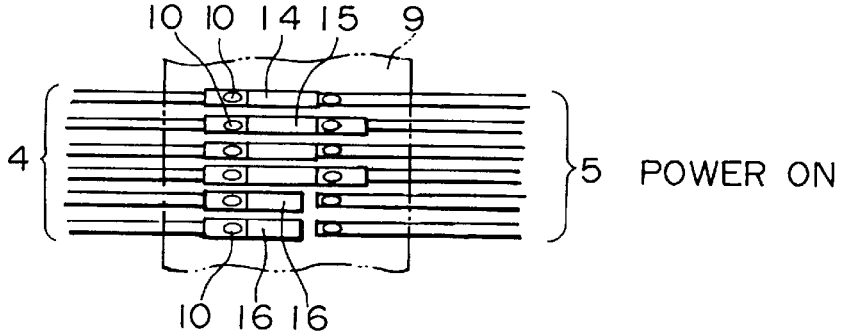
Figure 3D:
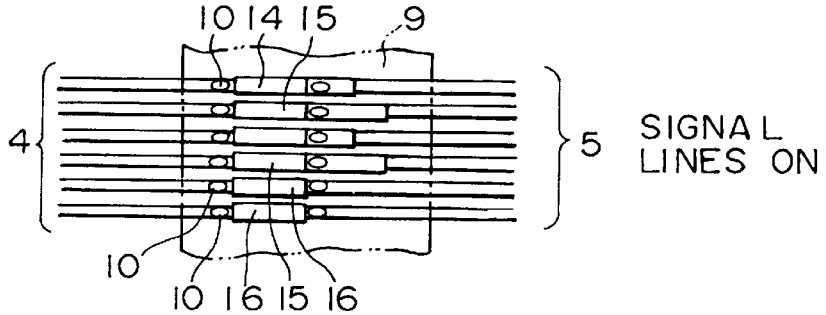
Figure 4A:
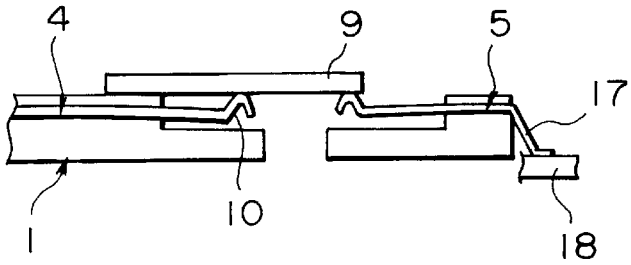
FIGS. 4A and 4B are longitudinal sectional views of the IC card connector corresponding to the states shown in FIGS. 3A and 3D, respectively.
Figure 4B:
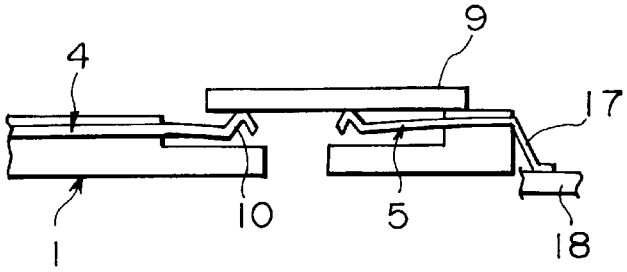
Figure 5:
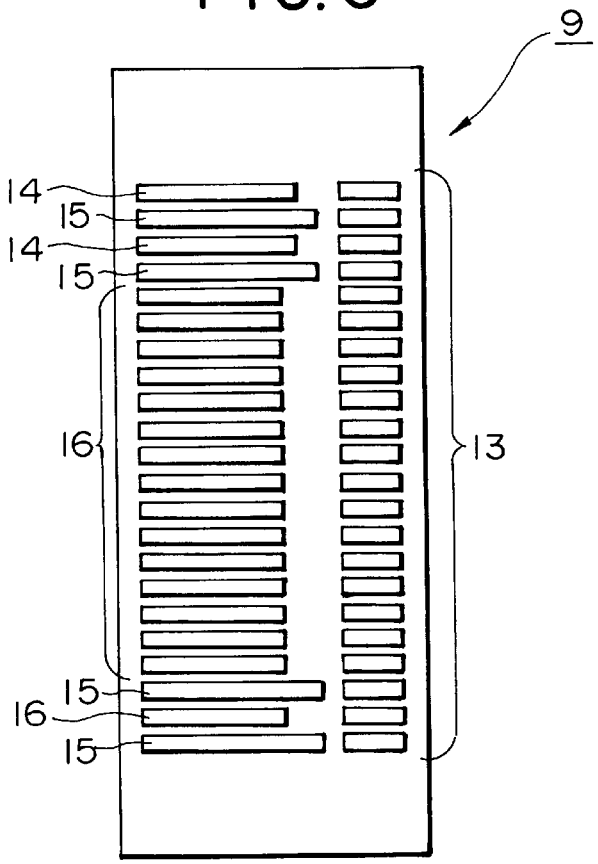
FIG. 5 is a plan view of the mode circuit board.

FIGS. 1A and 1B are, respectively, a plan view and a side view showing generally the IC card connector of a first embodiment of the present invention, FIGS. 2A–2C show the operation of the IC card connector, FIGS. 3A–3D show the relationship of first brushes, a mode circuit board and second brushes in the operation of the IC card connector, FIGS. 4A and 4B are longitudinal sectional views of the IC card connector corresponding to the states shown in FIGS. 3A and 3D, respectively, and FIG. 5 is a plan view of the mode circuit board.

The basic construction of the first embodiment is now discussed referring to FIGS. 1A and 1B and FIG. 5.

As shown, a tray 1 comprises a mount 3 on which the IC card 2 is placed, a plurality of first terminal members (hereinafter referred to first brushes) 4 insert-molded in the tray 1 and supported at their generally central portions side by side in a brushlike fashion, and a plurality of second terminal members (hereinafter referred to as second brushes) 5 insert-molded in the tray 1 and supported at their generally central portions side by side in a brushlike fashion.

As shown in FIG. 5, a mode circuit board 9 has short strip contacts 13 juxtaposed along one side of the board and power supply traces 14, ground traces 15, and signal traces 16 juxtaposed along the opposite side of the board in such a manner that the short strip contacts 13 are aligned end on to the respective traces 14, 15, and 16 with longitudinal spacings therebetween. The power supply traces 14, the ground traces 15 and the signal traces 16 are aligned at their one ends. The signal traces 16 are shortest in length, the power supply traces 14 of middle length and the ground traces 15 the longest. As the mode circuit board 9 moves, the power supply traces 14, the ground traces 15 and the signal traces 16 and strip contacts 13 slides along the first brushes 4 and the second brushes 5.

Both ends of each of the first brushes 4 are projected out of the tray 1. As a contact point 8, one end of each brush 4 is projected out of the inner bottom surface of the mount 3 to be in contact with a corresponding contact point 7 of the IC card 2. The contact points 8 of the first brushes 4 are arranged in a zigzag configuration with one brush longer than a next one. The brushes 4 extend from the card contact points 8 and terminated at contact points 10 which are to be in contact with the power supply traces 14, the ground traces 15, and the signal traces 16, respectively, on the mode circuit board 9 to be described later.

The contact points 10 to be in contact with the mode circuit board 9 are projected into a recess 11 formed in the tray 1. The contact points 8 to be in contact with the IC card may also be accommodated in a recess formed in the inner bottom of the mount 3.

The one ends of the second brushes 5 are projected into the recess 11 in the tray 1 and are respectively put into contact with the power supply traces 14, the ground traces 15 and the signal traces 16 on the mode circuit board 9. The other ends 17 of the brushes 5 are soldered to a circuit board 18 in a host apparatus.

By sliding the mode circuit board 9 along with the first brushes 4 and the second brushes 5, a sequence operation, for example, for transitioning from an all-line-off state to an all-line-on state is performed with the ground lines 15, the power supply lines 14 and then the signal lines 16 being closed or connected in that order. Another sequence operation from the all-line-on state to the all-line-off state is performed with the signal lines 16, the power supply lines 14 and the ground lines 15 being opened or disconnected.

By making different the lengths of the conductor traces to be in contact with either the first brushes 4 or the second brushes 5, a sequence operation may be carried out with the mode circuit board 9 driven by another mechanism (a shutter switching mechanism, for example).

Discussed referring to FIGS. 2A through 2C is the first embodiment of the present invention which further comprises a mechanism that permits the mode circuit board 9 to be slid along with a shutter. Components identical to those described with reference to FIG. 1 are designated with the same reference numerals.

As shown in FIGS. 2A–2C a shutter 20 is slidably inserted through a slit 21 formed in the tray 1 in a manner such that the shutter 20 covers the mount 3. The shutter 20 has a hook section 22 on its rear end (right end) on the top surface for preventing itself from coming off, and a tapered surface 23 running toward its rear end on the underside to thin the thickness of the rear end portion of the shutter 20. The tapered surface 23 allows the shutter 20 to smoothly press down on the IC card 2 that is placed in its tilted position on the mount 3 as shown in FIG. 2B.

The tray 1 in the first embodiment is of a fixed type, and is integrally formed with a guide section 24 on its rear side for accommodating and slidably guiding the mode circuit board 9. The guide section 24 has a recess 11 on its inner bottom and a step 25 to its left-hand side for defining the left limit of the range of sliding travel of the mode circuit board 9 as shown. With the shutter 20 opened (as shown in FIGS. 2A and 2B), the mode circuit board 9 is pressed against the step 25 by the force of a return spring 26. Although in the first embodiment, the mode circuit board 9 is attached to the underside of a sliding member, both may be integrally formed. The mode circuit board 9 collectively designates both the board itself and the sliding member.

The guide section 24 has in its underside of the top plate portion a recess 27 with which the hook section 22 of the shutter 20 is engaged. An eject arm 28 of an elastic movable strip defined by a U-shaped cutout is provided in the underside of the recess 27. By pressing down on the eject arm 28, the hook section 22 of the shutter 20 that is engaged with the step of the recess 27 as shown in FIG. 2C is lowered and thus disengaged from the recess 27.

When the shutter 20 is inserted to cover the mount (as shown in FIG. 2C), its (rear) end touches the left-hand abutment face 30 of the mode circuit board 9. The shutter 20 is still further pressed in the right direction against the urging of the return spring 26.

Designated 29 is a tapered surface that allows the hook section 22 of the shutter 20 to smoothly engage with the recess 27.

The operation of the first embodiment is now discussed.

In the state prior to the loading of the IC card shown in FIG. 2A, the shutter 20 is opened with the mount 3 for the IC card 2 exposed. The return spring 26 urges the mode circuit board 9 with its left-hand end pressed against the step 25.

In the state shown in FIG. 2A, the contact points 10 of the first brushes 4, the second brushes 5 and the mode circuit board 9 are positioned as shown in FIG. 3A. More particularly, the contact points 10 of the first brushes 4 are respectively put into contact with the power supply traces 14, the ground traces 15, and the signal traces 16. The second brushes 5 are respectively put into contact with the strip contacts 13, but are out of contact with the power supply traces 14, the ground traces 15 and the signal traces 16. Therefore, there is no electrical connection on all lines established between the first brushes 4 and the second brushes 5 (the all-line-off state).

When the IC card 2 is placed on the mount 3 as shown in FIG. 2A, the contact points 7 of the IC card 2 respectively ride on the contact points 8 of the first brushes 4 projected out of the inner bottom surface of the mount 3 as shown in FIG. 2B.

When the shutter 20 is further inserted rightward from the state shown in FIG. 2B, the tapered surface 29 on its right end portion on the underside of the shutter 20 slides on the top surface of the IC card 2 while pressing down on the IC card 2. With the IC card 2 pressed down, the contact points 8 of the first brushes 4 are also pressed down against their own elasticity. Finally, the IC card 2 is seated between the mount 3 and the shutter 20 as shown in FIG. 2C, pressing its own contact points 7 into contact with the contact points 8.

With the shutter 20 fully inserted, its rear end is pressed against the abutment face 30 of the mode circuit board 9 that is urged by the return spring 26 against the step 25 on the left-hand side. Against the urging of the return spring 26, the mode circuit board 9 moves, thereby performing the sequence connection operation.

In the sequence connection operation, as shown in FIG. 3A, all lines are still off (not connected) in both states shown in FIGS. 2A and 2B. As already described, when the mode circuit board 9 is forced rightward in FIG. 2B, it slides along the first brushes 4 and the second brushes 5, both being fixed, and thus second brushes 5 are first put into contact with the ground traces 15 as shown in FIG. 3B. The contact points 8 of first brushes 4 connected to the ground contact points 7 of the IC card 2 are electrically connected to second brushes 5 via the ground traces 15, and thus the ground connection is established. In the state shown in FIG. 3B, the ground lines only are on.

When the mode circuit board 9 is moved further rightward in FIG. 2B from the state shown in FIG. 3B, the power supply traces 14 are put into contact with the corresponding second brushes 5 to switch on the power supply lines as shown in FIG. 3C. In the state shown in FIG. 3C, the ground lines and the power supply lines are on while the signal lines are off.

When the mode circuit 9 is moved yet further rightward in FIG. 2B, from the state shown in FIG. 3C, the signal traces 16 are put into contact with the corresponding second brushes 5 to switch on the signal lines as shown in FIG. 3D. In the state shown in FIG. 3D, all of the ground lines, power supply lines and signal lines are on.

The state shown in FIG. 3D corresponds to the state shown in FIG. 2C, in which the hook section 22 is deflected downward to be engaged with the recess 27 as the shutter 20 is inserted at its final stage of closing operation. With this engagement, the mode circuit board 9 is restrained at its right limit of the range of sliding travel against the urging of the return spring 26 to keep the all-line-on state (the state shown in FIG. 3D).

In this way, along with the closing operation of the shutter 20, the sequence connection operation is performed connecting the ground lines, power supply lines and then signal lines in that order.

The unloading operation of the IC card 2 is now discussed.

Pressing down on the eject arm 28 from the state shown in FIG. 2C presses down the hook section 22 of the shutter 20 engaged with the recess 27, thereby disengaging the hook section 22 from the recess 27. The mode circuit board 9 is now moved leftward by the urging of the return spring 26 until it abuts the step 25. In the course of the leftward movement of the mode circuit board 9, the above-described connection sequence is performed in reverse order. More particularly, as the mode circuit board 9 moves leftward, the contact points 10 of the first brushes 4 connected to the signal traces 16 are disconnected therefrom, the contact points 10 of the first brushes 4 connected to the power supply traces 14 are disconnected therefrom, and then, the contact points 10 of the first brushes 4 connected to the ground traces 15 are disconnected therefrom.

As the mode circuit board 9 moves leftward, the shutter 20 is moved leftward with the abutment face 30 pressing against the shutter 20. When the shutter 20 projected in this way is drawn as shown in FIG. 2B, the IC card 2 is free to be unloaded from the mount 3 as shown in FIG. 2A.

It is important that the sequence mechanism is operated in reverse to sequentially turn off the signal lines, power supply lines and ground lines as the mode circuit board 9 is moved leftward. It is also important that the IC card must be free to be removed when the sequence operation is complete.

In the first embodiment, the mode circuit board 9 is moved along with the opening and closing operations of the shutter 20 after the IC card 2 is placed. Alternatively, the mode circuit board 9 may be moved along with a revolving cover.

According to the first embodiment, the IC card, the connector connection mechanism, and the sequence operation mechanism are arranged on respective planar configurations, and thus a thin IC card connector is provided.

According to the first embodiment, the connection of the connector with the IC card 2 is constituted by the brushes 4 only, and thus a thin design is easily implemented in the IC card connector. If the sequential connection function is not implemented in the connection between the IC card 2 and the brushes 4, the quantity of deflection of the brushes 4 (or brushes 5) is minimized. The load applied on the brushes is reduced compared with the prior art, and thus the tray 1 on which the brushes 4 and 5 are mounted and the cover (20) are made thin in construction.

Since the deflection quantity of the brushes 4 and 5 is set smaller than in the prior art, stress generated in the brushes 4 and 5 is reduced, and the life of the connector is prolonged.

Since the sequence mechanism is a separate one, deformation in the IC card 2 or offset in the position of the IC card 2, to some degree, are accommodated. The sequence operation is thus performed in a safe and reliable manner.

A second embodiment of the present invention is now discussed.

Figure 6A:
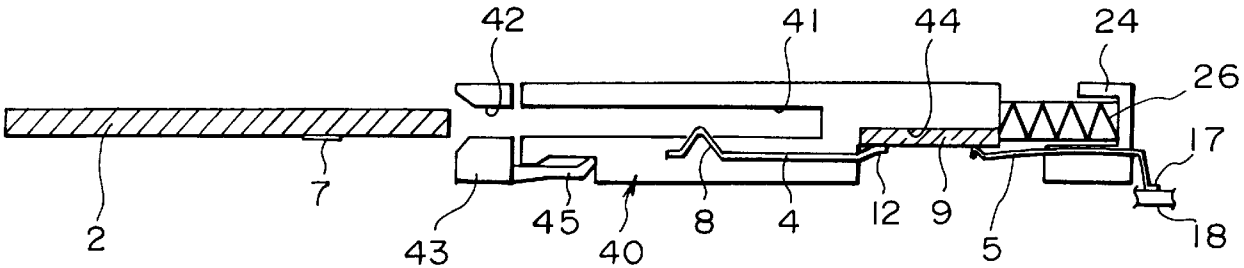
FIGS. 6A–6C show the operation of the IC card connector according to a second embodiment of the present invention.
Figure 6B:
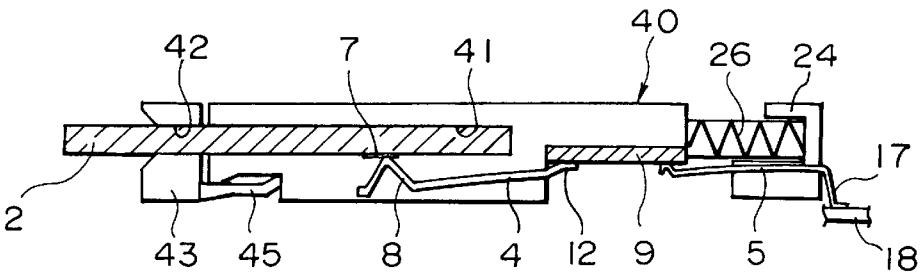
Figure 6C:
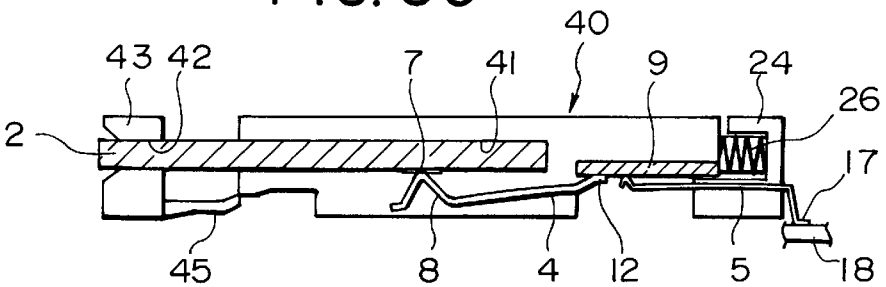
Figure 7A:
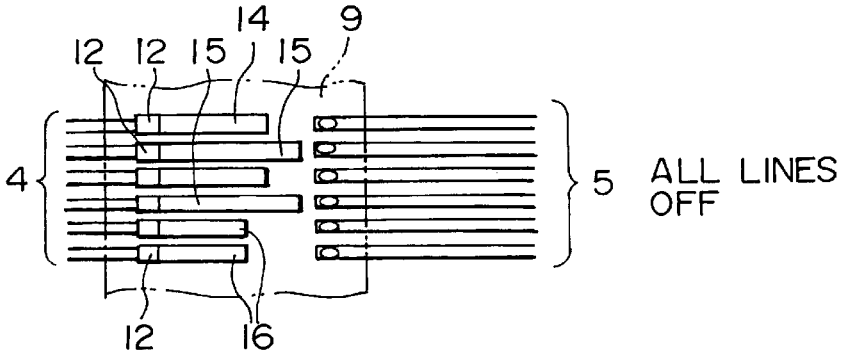
FIGS. 7A–7D show the relationship of first brushes, a mode circuit board, and second brushes in the operation of the IC card connector according to the second embodiment of the present invention.
Figure 7B:
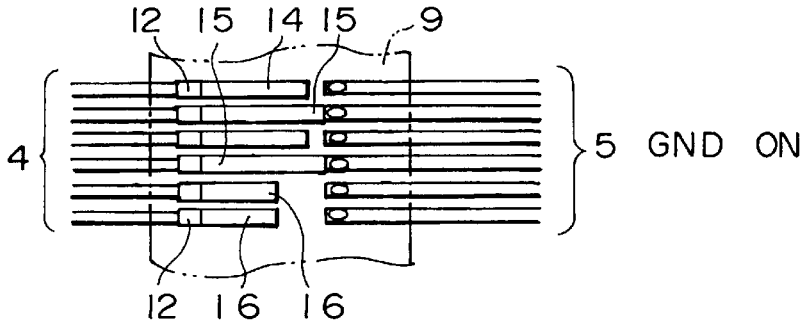
Figure 7C:
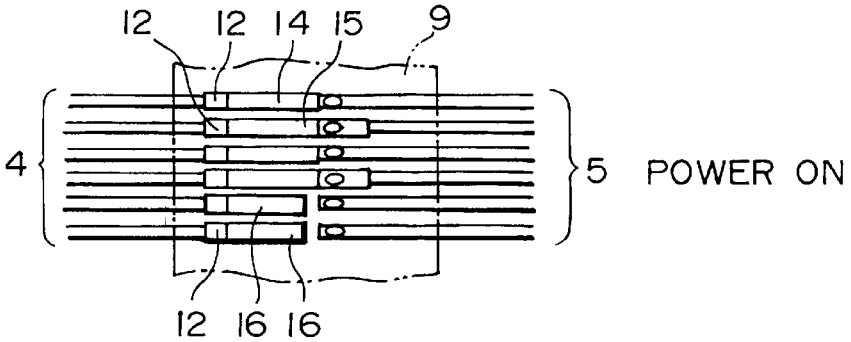
Figure 7D:
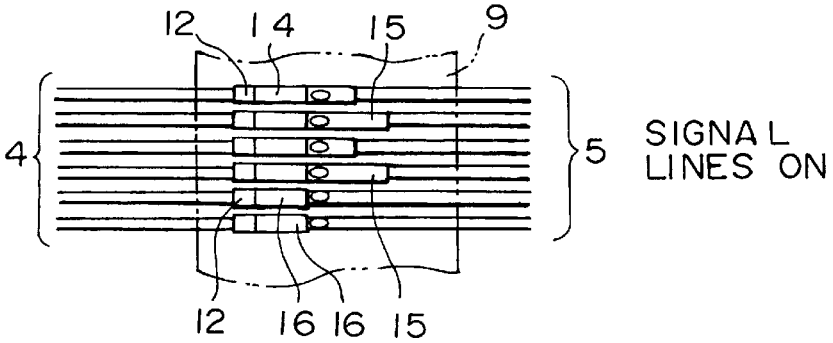
Figure 8A:
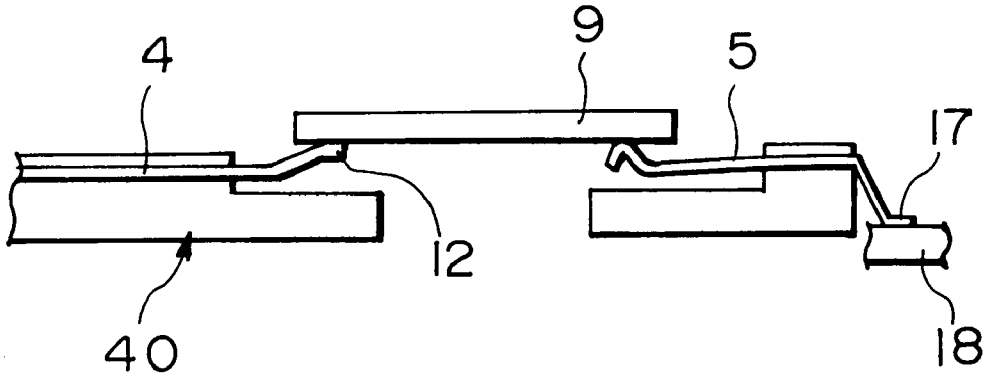
FIGS. 8A and 8B are longitudinal sectional views of the IC card connector corresponding to the states shown in FIGS. 7A and 7D, respectively.
Figure 8B:
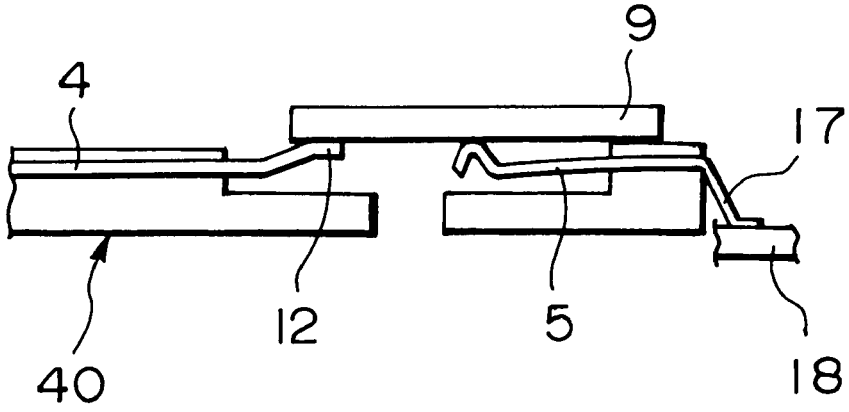

FIGS. 6A–6C show the operation of the IC card connector according to a second embodiment of the present invention, FIGS. 7A–7D show the relationship of first brushes, a mode circuit board, and second brushes in the operation of the IC card connector according to the second embodiment of the present invention, and FIGS. 8A and 8B are longitudinal sectional views of the IC card connector corresponding to the states shown in FIGS. 7A and 7D, respectively.

In the second embodiment, the first brushes 4 are soldered to conductor traces of the mode circuit board 9 so that the first brushes 4 and the mode circuit board 9 are moved along with the movement of the IC card 2. With the IC card 2 loaded, the connection sequence operation is performed by moving the tray on which the first brushes 4 and the mode circuit board 9 are mounted. The second embodiment has a construction suitable for use in a slot-in type application where the IC card 2 is inserted into the slot in the plane of the slot rather than from lateral directions of the slot. Components identical to those described with reference to the first embodiment are designated with the same reference numerals.

Referring to FIGS. 6A–6C, the tray 40 is slidably supported to move sideward directions as shown, and is provided with a slot 41 into which the IC card 2 is seated. Also arranged is a mouth 43 constituting the guide opening 42 facing in alignment with the opening of the slot 41.

The contact points 8 of the first brushes 4 are projected out of the inner bottom surface of the slot 41 in a manner that allow the first brushes 4 to deflect. The bottom right portion of the tray 40 is cut out to form a recess 44, and the mode circuit board 9 is secured to the underside of the recess 44. The right ends 12 of the first brushes 4 are projected into the recess 44 and soldered respectively to the power supply traces 14, ground traces 15 and signal traces 16. In the same manner as in the first embodiment, the second brushes 5 that are insert molded in the tray 40 are respectively put into sliding contact with the power supply traces 14, ground traces 15 and signal traces 16 on the mode circuit board 9.

An elastic hook 45 is extended from the mouth 43 in the direction of sliding motion of the tray 40. The elastic hook 54 is put into a locking engagement with the bottom left corner of the tray 40. When pressed down on by an unshown eject mechanism, the elastic hook 45 is deflected downward and put out of engagement, and the tray 40 is returned back to the position shown in FIGS. 6A and 6B by the urging of the return spring 26.

The operation of the second embodiment is now discussed.

In the stage prior to loading of the IC card 2 as shown in FIG. 6A, the contact points 8 of the first brushes 4 remain projected out of the inner bottom surface of the slot 41 for receiving the IC card 2. The urging of the return spring 26 forces the tray 40 to its front limit of the range of sliding travel of the tray (on the left-hand side in FIG. 6A). Since the mode circuit board 9 is secured to the tray 40 in the second embodiment, the mode circuit board 9 is also positioned to its front limit of the range of sliding travel (on the left-hand side in FIG. 6A).

In the state in FIG. 6A (and also FIG. 6B), the first and second brushes 4, 5 and the mode circuit board 9 are positioned as shown in FIG. 7A. More particularly, the first brushes 4 are soldered to the mode circuit board 9, and thus electrically respectively connected to the power supply traces 14, ground traces 15 and signal traces 16 on the mode circuit board 9, while the second brushes 5 are out of contact with the power supply traces 14, ground traces 15 and signal traces 16 on the mode circuit board 9. Thus, the power supply lines, ground lines and signal lines are all off.

When the IC card 2 is inserted through the guide opening 42 into the slot 41, the IC card 2 presses down on the contact points 8 of the first brushes 4 projected out of the inner bottom surface of the slot 41 as shown in FIG. 2B, thereby putting the contact points 7 into sliding contact with the contact points 8.

When the IC card 2 is further inserted from the state shown in FIG. 6B, the right end of the IC card 2 impacts on the dead end surface of the slot 41, thereby forcing rightward the tray 40 and the mode circuit board 9 together with the IC card 2 against the urging of the return spring 26.

As the mode circuit board 9 moves rightward, the connection sequence operation is carried out with the ground lines, power supply lines and signal lines in that order being switched on as shown in FIGS. 7A–7D.

The sequence connection operation is at the all-line-off state in FIG. 7A corresponding to FIGS. 6A and 6B. When the mode circuit board 9 along with the tray 40 is moved rightward in FIG. 6B, the mode circuit board 9 (along with the first brushes 4) are put into sliding contact with the second brushes 5 fixed. As shown in FIG. 7B, the ground traces 15 first are put into sliding contact with the corresponding second brushes 5, thereby switching the ground lines on.

When the mode circuit board 9 is further moved rightward, the power supply traces 14 are put into sliding contact with the corresponding second brushes 5 as shown in FIG. 7C, thereby switching the power supply lines on. The ground traces 15 remain in contact with the corresponding brushes 5 keeping the ground lines on.

When the mode circuit board 9 is yet further moved rightward, the signal traces 16 are put into sliding contact with the corresponding second brushes 5 as shown in FIG. 7D, thereby switching the signal lines on, while the ground lines and power lines are kept on.

The unloading operation of the IC card 2 in the second embodiment is now discussed.

When the elastic hook 45 is pressed down by manipulating the unshown eject mechanism from the state shown in FIG. 6C, the hook 45 is disengaged from the bottom left corner of the tray 40, and the tray 40 (along with the mode circuit board 9) is moved leftward by the urging of the return spring 26 until it abuts the end (unshown restraint member) of the hook 45.

As the tray 40 slides from the state in FIG. 6C to the state in FIG. 6B, the above-described sequence operation is performed in reverse (now from FIG. 7D to FIG. 7A). More specifically, as the mode circuit board 9 along with the tray 40 moves leftward, the second brushes 5 that were in contact with the signal traces 16 as shown in FIG. 7D are disconnected from those as shown in FIG. 7C, the second brushes 5 that were in contact with the power supply traces 14 are disconnected from those as shown in FIG. 7B, and the second brushes 5 that were in contact with the ground traces 15 are disconnected from those as shown in FIG. 7A. The IC card 2 is now at the all-line-off state.

Referring to FIG. 6B, the IC card 2 is partly exposed out of the guide opening 42 of the mouth 43 so that it can be pulled out as shown in FIG. 6A.

A third embodiment of the present invention is now discussed.

Figure 9A:
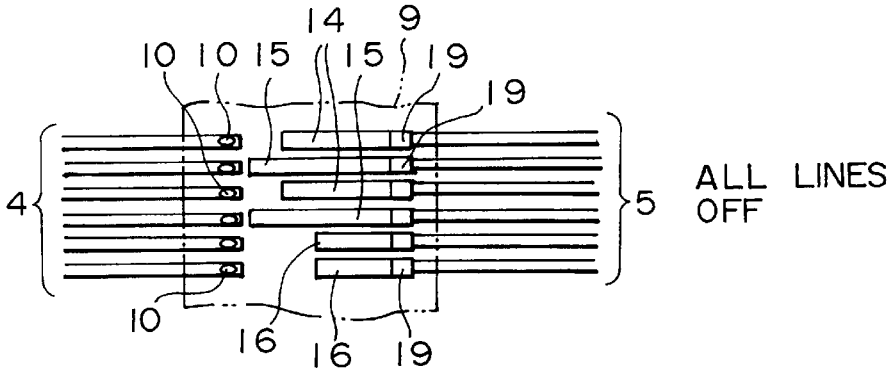
FIGS. 9A–9D show the relationship of first brushes, a mode circuit board, and second brushes in the operation of the IC card connector according to a third embodiment of the present invention.
Figure 9B:
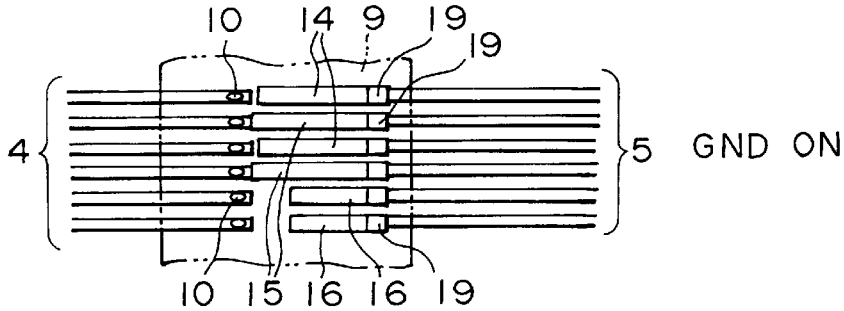
Figure 9C:
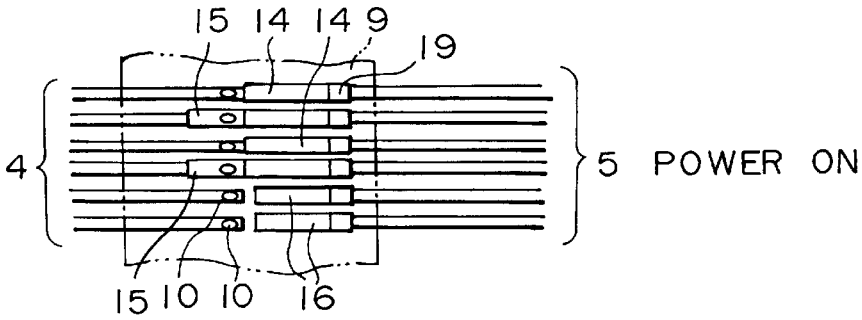
Figure 9D:
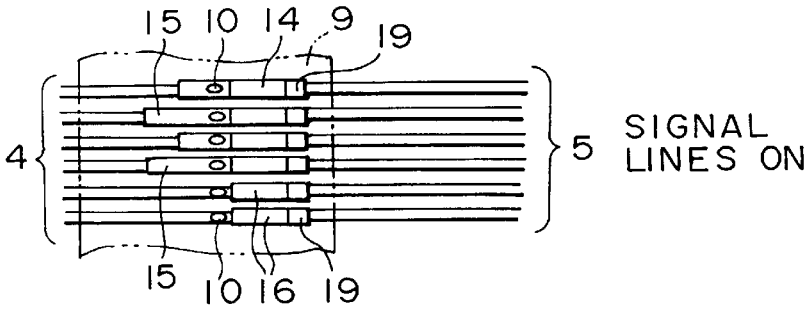
Figure 10A:
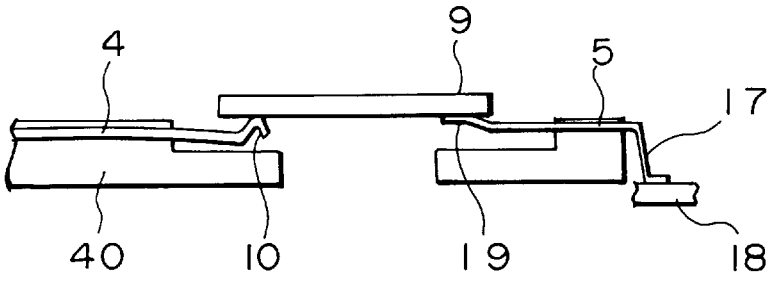
FIGS. 10A and 10B are longitudinal sectional views of the IC card connector corresponding to the states shown in FIGS. 9A and 9D, respectively.
Figure 10B:
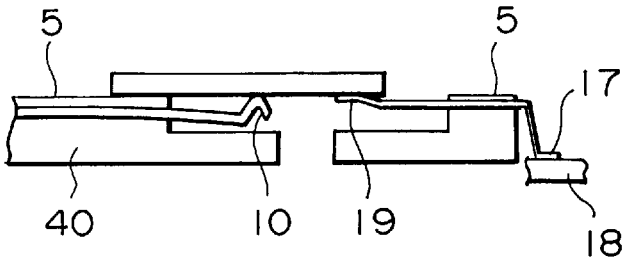
Figure 11:
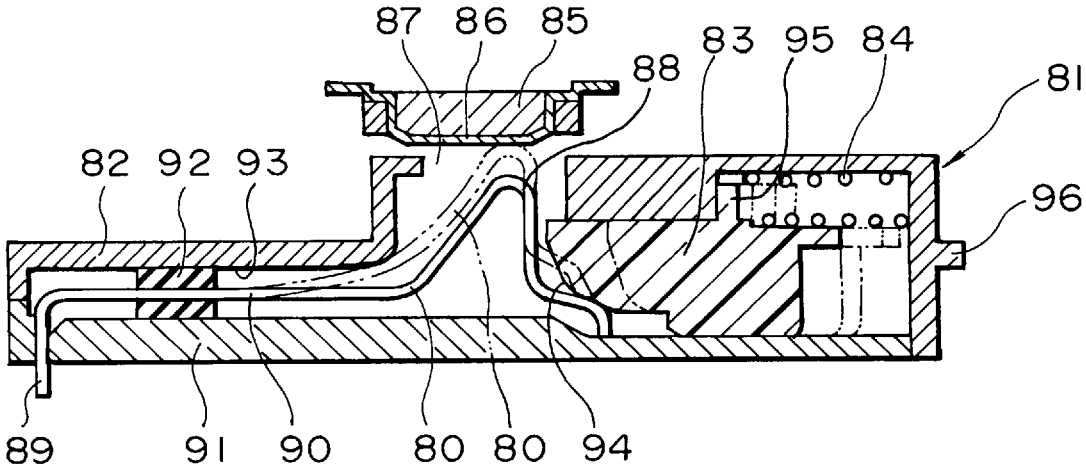
FIG. 11 PRIOR ART
FIG. 11 is an explanatory view of a prior art IC connector.

FIGS. 9A–9D show the relationship of first brushes, a mode circuit board, and second brushes in the operation of the IC card connector according to the third embodiment of the present invention, and FIGS. 10A and 10B are longitudinal sectional views of the IC card connector corresponding to the states shown in FIGS. 9A and 9D, respectively.

The third embodiment is also suitable for use in a slot-in type application. The third embodiment is similar to the second embodiment in construction except that the mode circuit board 9 is attached to a circuit board 18 rather than the tray 40. Components identical to those described with reference to the second embodiment are designated with the same reference numerals.

The difference of the third embodiment from the second embodiment is chiefly discussed. In the third embodiment, the mode circuit board 9 is supported by a casing or other support member (not shown) in a manner that the conductor traces of the board 9 face the second brushes 5 as shown in FIGS. 10A and 10B. The power supply traces 14, ground traces 15, and signal traces 16 on the mode circuit board 9 fixed are soldered to the left ends 19 of the respective brushes 5.

On the other hand, the first brushes 4 are projected at their right ends as contact points 10 in the same manner as in the first embodiment, and the power supply traces 14, ground traces 15, and signal traces 16 on the mode circuit board 9 are put into sliding contact with the corresponding contact points 10.

The operation of the third embodiment is now discussed.

In the connection sequence operation, the IC card is at the all-line-off state as shown in FIGS. 9A and 10A. When the first brushes 4 along with the tray 40 is moved rightward in FIGS. 9A and 10A as already described, the contact points 10 of the first brushes 4 slide rightward on the mode circuit board 9 fixed. As shown in FIG. 9B, the ground traces 15 are put into sliding contact with the corresponding first brushes 4, thereby switching the ground lines on.

When the contact points 10 of the first brushes 4 move rightward along with the rightward sliding of the tray 40 in FIG. 9B, the power supply traces 14 are put into sliding contact with the corresponding contact points 10 of the first brushes 4 as shown in FIG. 9C, thereby switching also the power supply lines on.

When the contact points 10 of the first brushes 4 move further rightward in FIG. 9C, the signal traces 16 are put into sliding contact with the corresponding contact points 10 of the first brushes 4 as shown in FIGS. 9D and 10B, thereby switching the signal lines on as well, thus all the lines on.

The construction and operation unless otherwise described herein remain the same as those of the second embodiment. The reverse sequence operation transitioning from the all-line-on state to the all-line-off state in the third embodiment also remains the same as that of the second embodiment. Thus, the corresponding operational description is omitted. The IC card 2 is loaded and unloaded into the tray 40 in the same manner as in the second embodiment.

According to the first through fourth aspects of the present invention, the IC card, the connector connection mechanism, and the sequence operation mechanism are arranged on respective planar configurations, and thus a thin IC card connector is provided.

The connection of the connector with the IC card is constituted by the brushes only, and thus a thin design is easily implemented in the IC card connector. If the sequential connection function is not implemented in the connection between the IC card and the brushes, the quantity of deflection of the brushes is minimized. The load applied on the brushes is reduced compared with the prior art, and thus the tray on which the brushes are mounted and the cover are made thin in construction.

Since the deflection quantity of the brushes is set smaller than in the prior art, stress generated in the brushes is reduced, and the life of the connector is prolonged.

Since the sequence mechanism is a separate one, deformation in the IC card or offset in the position of the IC card, to some degree, are accommodated. The sequence operation is thus performed in a safe and reliable manner.

What is claimed is:

1. An IC card connector comprising:

brushlike first terminal members that are respectively connected to a plurality of contact points for power supply lines, ground lines and signal lines of an IC card when the IC card is loaded, brushlike second terminal members which are spaced from and respectively oppose the first terminal members, and which are not directly connected to the first terminal members but connected to a circuit board of a host apparatus, and a sequence mechanism containing a mode circuit board between the first terminal members and the second terminal members, the mode circuit board being slidable along a surface of the loaded IC card in a direction in which the first terminal members oppose the second terminal members, the mode circuit board sliding and defining the connection sequence of the contact points of the IC card to perform a sequence operation by making or breaking the connections between the first terminal members and the second terminal members according to the defined connection sequence, wherein by operating the sequence mechanism, the sequence operation is performed with the contact points of the IC card remaining connected to the first terminal members.

2. An IC card connector according to claim 1, wherein the sequence mechanism comprises the mode circuit board having a plurality of juxtaposed conductor traces that are of different lengths depending on the connection sequence, and wherein the mode circuit board is slidably moved relative to at least either the first terminal members or the second terminal members so that the conductor traces are put into contact therewith.

3. An IC card connector according to claim 1, wherein the sequence operation is performed by sliding the mode circuit board toward either the first terminal members or the second terminal members in one form of sequence in which the power supply lines, the ground lines and the signal lines are transitioned from an all-line-off state to an all-line-on state in the order of the ground lines, the power supply lines and the signal lines, or conversely in the other form of sequence in which the power supply lines, the ground lines and the signal lines are transitioned from the all-line-on state to the all-line-off state in the order of the signal lines, the power supply lines, and the ground lines.

4. An IC card connector according to claim 2, wherein the mode circuit board of the sequence mechanism is provided with a plurality of conductor traces including power supply traces, ground traces, and signal traces, juxtaposed in a side-by-side manner with a spacing provided therebetween, the power supply traces, the ground traces and the signal traces are of different length with the signal traces shortest, the power supply traces of middle length and the ground traces longest while the power supply traces, the ground traces and the signal traces are aligned at one ends in a line.

5. An IC card connector according to claim 2, wherein the mode circuit board of the sequence mechanism is slidably movable in a manner such that the mode circuit board slides along with the opening and the closing operations of the cover of a fixed tray on which the IC card is mounted.

6. An IC card connector according to claim 2, wherein the mode circuit board of the sequence mechanism is fixed to a tray, which is supported slidably in the direction of insertion and detraction of the IC card, and wherein the mode circuit board is slid along with the sliding motion of the tray, relative to the second terminal members.

7. An IC card connector according to claim 2, wherein the mode circuit of the sequence mechanism is fixed to the second terminal members and a tray is supported slidably in the direction of insertion and detraction of the IC card, and wherein the first terminal members are slid along with the sliding motion of the tray, relative to the mode circuit board that is fixed to the second terminal members.

* * * * *

UNITED STATES PATENT AND TRADEMARK OFFICE

CERTIFICATE OF CORRECTION

PATENT NO. : 6,056,573
DATED : May 2, 2000
INVENTOR(S) : Toru Nishioka

It is certified that error appears in the above-identified patent and that said Letters Patent is hereby corrected as shown below:

Column 11,
Line 4, delete "ends" and substitute -- end -- in its place.

Signed and Sealed this

Twenty-eighth Day of May, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,056,573
DATED : May 2, 2000
INVENTOR(S) : Toru Nishioka

It is certified that error appears in the above-identified patent and that said Letters Patent is hereby corrected as shown below:

Title page,
Item [56], References Cited, U.S. PATENT DOCUMENTS, insert the following:

| | | | |
|---|---|---|---|
| -- 4,874,323 | 10/1989 | Shibano | 439/260 |
| 4,887,188 | 12/1989 | Yoshida et al. | 361/684 --. |

Signed and Sealed this

Seventeenth Day of August, 2004

JON W. DUDAS
*Acting Director of the United States Patent and Trademark Office*